US008539617B2

(12) United States Patent
Murillo

(10) Patent No.: US 8,539,617 B2
(45) Date of Patent: Sep. 24, 2013

(54) SANITARY TOILET

(76) Inventor: Wenceslao Murillo, Long Beach, CA (US)

( * ) Notice: Subject to any disclaimer, the term of this patent is extended or adjusted under 35 U.S.C. 154(b) by 0 days.

(21) Appl. No.: 13/373,944

(22) Filed: Dec. 5, 2011

(65) Prior Publication Data

US 2012/0180207 A1 Jul. 19, 2012

Related U.S. Application Data

(60) Provisional application No. 61/458,943, filed on Dec. 3, 2010.

(51) Int. Cl.
*A47K 13/10* (2006.01)

(52) U.S. Cl.
USPC ..... 4/246.1

(58) Field of Classification Search
USPC ..... 4/246.1–246.5
See application file for complete search history.

(56) References Cited

U.S. PATENT DOCUMENTS

| | | | | | |
|---|---|---|---|---|---|
| 1,589,353 | A * | 6/1926 | Bock et al. | 137/362 |
| 1,614,346 | A * | 1/1927 | Coret | 4/249 |
| 1,615,523 | A * | 1/1927 | Shimo | 4/249 |
| 2,200,687 | A * | 5/1940 | Bercot | 4/246.1 |
| 2,283,678 | A * | 5/1942 | Landis | 4/408 |
| 3,594,828 | A * | 7/1971 | Seek | 251/294 |
| 3,594,829 | A * | 7/1971 | Seek | 251/295 |
| 4,007,499 | A * | 2/1977 | Lin | 4/249 |
| 4,103,371 | A * | 8/1978 | Wilson | 4/246.2 |
| 4,150,446 | A * | 4/1979 | Crocker | 4/246.3 |
| 4,470,161 | A * | 9/1984 | Seabrooke | 4/246.3 |
| 4,975,988 | A * | 12/1990 | Won | 4/246.3 |
| 5,014,367 | A * | 5/1991 | Gamblin | 4/246.2 |
| 5,029,347 | A * | 7/1991 | Lin | 4/246.2 |
| 5,056,165 | A * | 10/1991 | Wescott, Sr. | 4/246.1 |
| 5,068,925 | A * | 12/1991 | Salibi | 4/249 |
| 5,142,708 | A * | 9/1992 | Johnson et al. | 4/249 |
| 5,170,513 | A * | 12/1992 | Ambooken et al. | 4/249 |
| 5,323,496 | A * | 6/1994 | Blair | 4/246.3 |
| 5,327,589 | A * | 7/1994 | Rice | 4/246.2 |
| 5,339,468 | A * | 8/1994 | Lin | 4/246.5 |
| 5,349,703 | A * | 9/1994 | Mocilnikar et al. | 4/250 |
| 5,488,744 | A * | 2/1996 | Paananen | 4/246.2 |
| 5,504,947 | A * | 4/1996 | Robellop et al. | 4/246.1 |
| 5,659,902 | A * | 8/1997 | Roberts, Jr. | 4/246.3 |
| 5,754,985 | A * | 5/1998 | Dias | 4/246.1 |
| 6,089,542 | A * | 7/2000 | Caravella et al. | 251/295 |
| 6,233,751 | B1 * | 5/2001 | Ford | 4/246.5 |
| 6,263,517 | B1 * | 7/2001 | Brooks | 4/246.1 |
| 6,311,341 | B1 * | 11/2001 | Zwezdaryk | 4/254 |
| 6,351,856 | B1 * | 3/2002 | Browne | 4/246.2 |
| 6,434,759 | B1 * | 8/2002 | Pondelick et al. | 4/246.2 |
| 6,615,412 | B1 * | 9/2003 | Hammond | 4/246.1 |
| 6,651,262 | B1 * | 11/2003 | Tinsley | 4/246.1 |
| 6,907,621 | B2 * | 6/2005 | Stemen | 4/246.1 |
| 6,968,579 | B1 * | 11/2005 | Feinberg et al. | 4/246.1 |
| 7,003,815 | B2 * | 2/2006 | Herbst | 4/246.2 |
| 7,975,322 | B1 * | 7/2011 | Heller | 4/249 |
| 8,020,221 | B2 * | 9/2011 | Borochov et al. | 4/246.2 |
| 8,214,933 | B1 * | 7/2012 | Gaudin | 4/246.1 |

* cited by examiner

*Primary Examiner* — Lori Baker
(74) *Attorney, Agent, or Firm* — Ruth Evre

(57) ABSTRACT

The invention provides a mechanism to lift a toilet seat. A depressable foot pedal connects to a rod which rod is connected to the lid of the toilet seat. When the pedal is depressed, the rod lifts and thus lifts the lid of the toilet seat. A second depressable foot pedal connects to a second rod which is connected to the toilet seat. When the second pedal is depressed the rod lifts and thus lifts the toilet seat.

4 Claims, 4 Drawing Sheets

SANITARY TOILET

CLAIM OF PRIORITY

This patent application claims priority under 35 USC 119 (e) (1) from U.S. Provisional Patent Application Ser. No. 61/458,943 filed Dec. 3, 2010, of common inventorship herewith entitled, "Improved Sanitary Toilet."

FIELD OF THE INVENTION

The present invention pertains to the field of toilet devices, and more specifically to the field of hands free toilet devices.

BACKGROUND OF THE INVENTION

The prior art has put forth several designs for hands free toilet devices. Among these are:

U.S. Pat. No. 6,907,621 to Robert W. Stemen describes a toilet seat lifter with a flusher. A mechanism for raising and lowering a toilet seat in response to actuation of foot pedals is provided. An actuation cylinder with a contained piston is connected between the toiled bowl and the toilet seat. Water from the supply line for the toilet is routed to the actuator cylinder when a "seat up" pedal is depressed and causes the piston to extend out of the actuation cylinder and raise the seat. Operation of a flush pedal causes the water within the actuation cylinder to drain so that the toilet seat lowers.

U.S. Pat. No. 6,968,579 to Richard B. Feinberg et al describes a flushing activator, a toilet seat, and lid lifting and closing mechanism. In the front of a standard toilet apparatus, left, middle, and right side pedals are mounted over a thin substrate between the toilet base and a floor. The pedals enclose a mechanical apparatus for tensioning cables connected to a junction box at the back end of the toilet.

U.S. Pat. No. 7,003,815 to Eric Herbst describes an apparatus and method for foot actuating a toilet by providing a foot pedal having an enhoused cable extending therefrom. The cable is attached inside the toilet tank to a flushing means within the tank.

None of these prior art references describe the present invention.

SUMMARY OF THE INVENTION

It is an object of the present invention to provide an improved hands free toilet device.

DETAILED DESCRIPTION OF THE INVENTION

Figure 2:
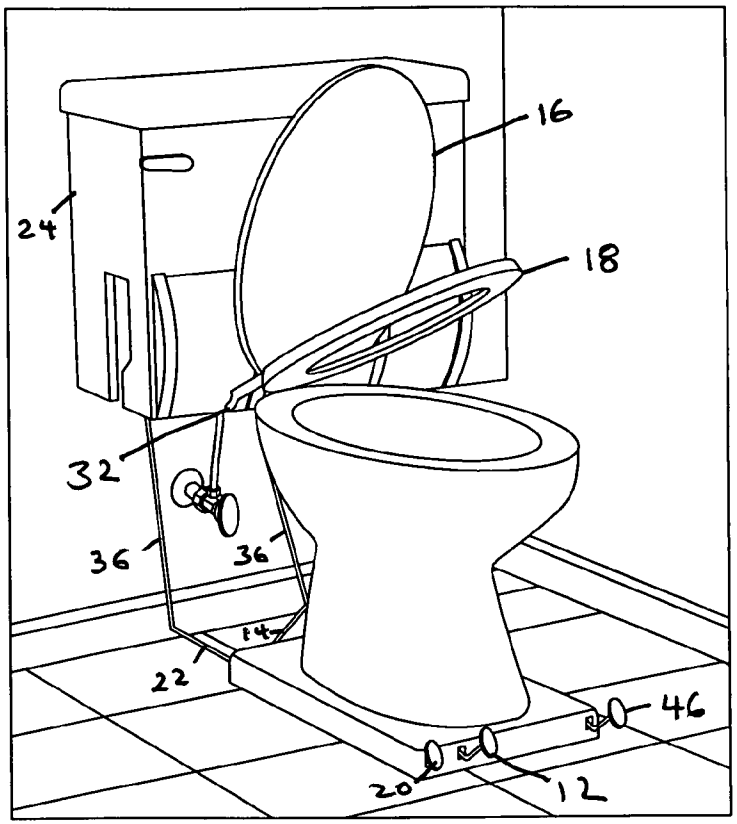
FIG. 2 is an elevational angled perspective view of the device of the present invention with the seat and lid open.
Figure 1:
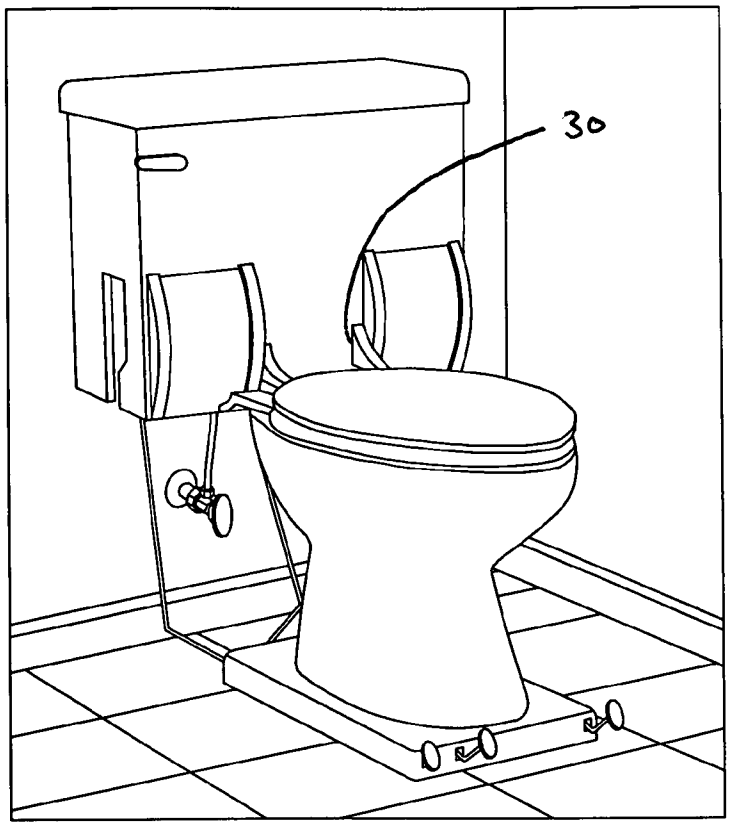
FIG. 1 is an elevational angled perspective view of the device of the present invention with the seat closed.
Figure 4:
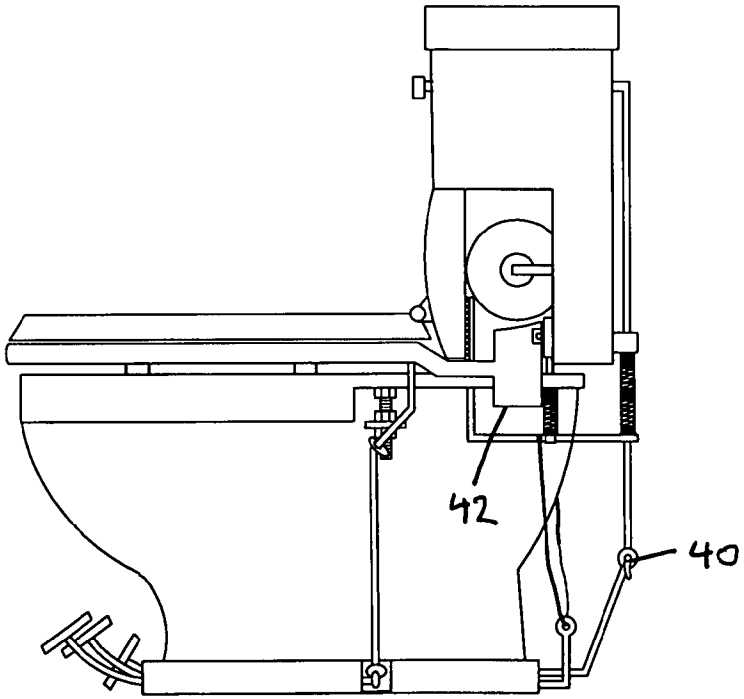
FIG. 4 is a right side view of the device of the present invention.
Figure 3:
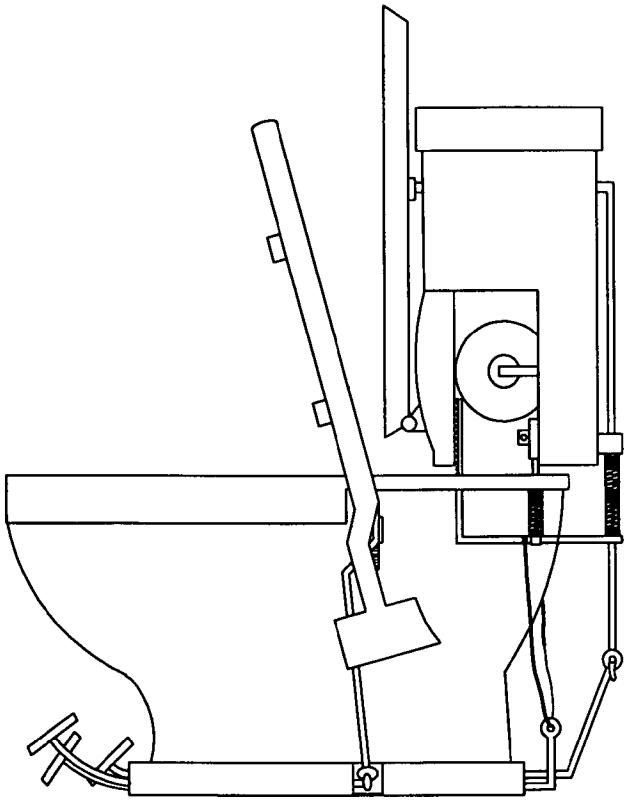
FIG. 3 is a left side view of the device of the present invention.
Figure 5:
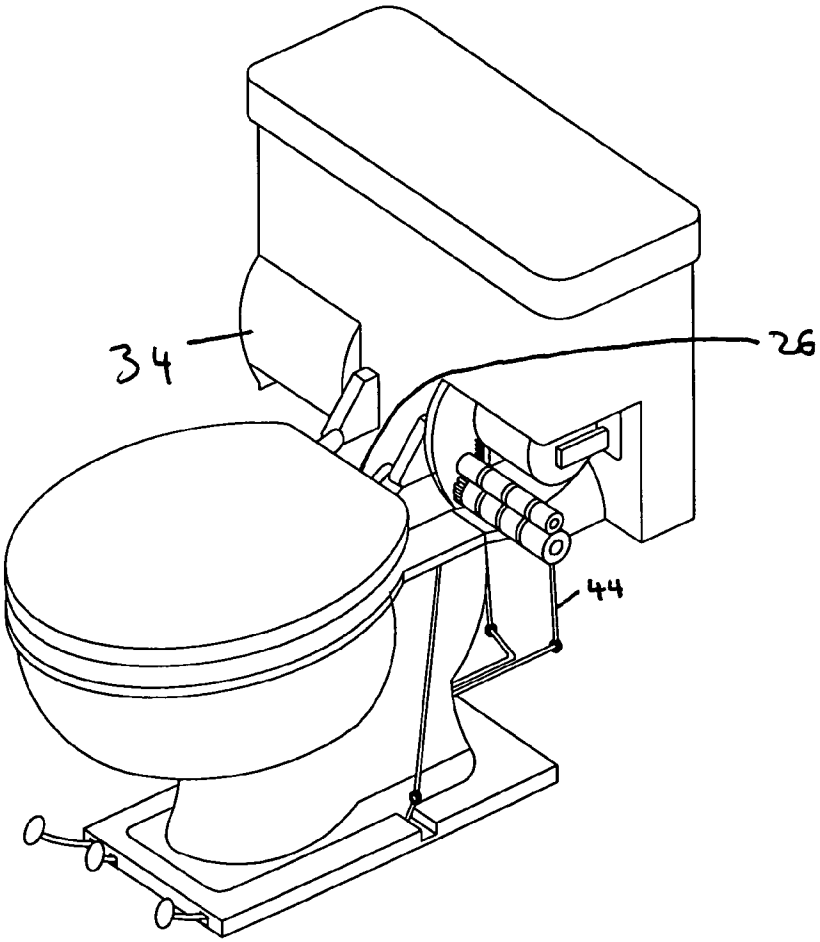
FIG. 5 is a top perspective view of the device of the present invention with the lid closed.
Figure 6:
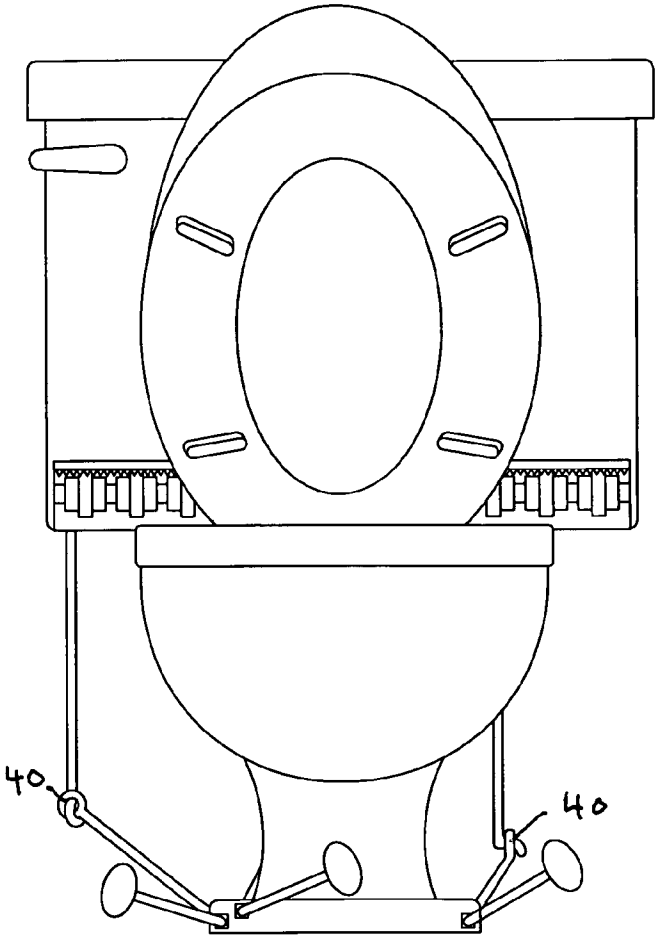
FIG. 6 is a front view of the device of the present invention with the lid and seat open.

The present invention, hereinafter referred as the Improved Sanitary Toilet, offers a practical solution to the problems associated with germs and bacteria which may be lingering on a toilet seat or handle. The Improved Sanitary Toilet is a specially designed toilet featuring hands free operation, thus offering consumers a more sanitary means of using the facilitates. As an added design feature, the Improved Sanitary Toilet also boasts an integrated dispenser, which distributes a sanitary seat cover over the toilet seat between uses. A modification to the design of standards flush toilets, the Improved Sanitary Toilet functions in a similar manner as a traditional toilets, with the addition of operational foot pedals utilized to dispense a protective paper cover over the toilet seat, flush the toilet and lift the toilet seat, respectively.

The Improved Sanitary Toilet bowl contains the mechanism to lift the toilet seat. The mechanism is composed of a series of metal rods that act as levers, cranks, cams, pivots and followers. A depressable foot pedal 12 connects to a rod 14 which rod is connected to the lid 16 of the toilet seat 18. When the pedal is depressed, the rod lifts and thus lifts the lid of the toilet seat. A second depressable foot pedal 20 connects to a second rod 22 which is connected to the toilet seat. When the second pedal is depressed the rod lifts and thus lifts the toilet seat. The lid of the sanitary toilet is attached to the tank 24 or to the center portion 26 of the pivot 32 between the toilet seat hinges 30. The toilet seat mechanism can only open the lid, in order to close the lid, this must be done manually. The paper dispenser 34 only works when the lid is open. The toilet seat is modified with two extensions 36 that act as levers at the back, one extension on each side of the toilet seat. Each extension is designed with a special shape, length and weight, so the toilet seat and extensions work as a lever using the hinges of the toilet seat as fulcrum. The shape of the extensions help to guide the paper towards the toilet seat coming from the paper dispensers contained on both sides at the base of the tank.

The weight 42 at the end of the extensions serves as a counterweight for the front part of the toilet seat. The same extensions hold the links or connections for the cylindrical rod folded as folded to work as a cam. This folded rod connects the extensions with a pedal at the bottom side of the toilet bowl. When the portion of the folded rod is displaced up and down through a static ring connected to the toilet bowl, it works as a cam and produces a semicircular movement at the top of the rod. The top part of the rod becomes a follower 44 that pulls the extensions down to the side via another cam mechanism between the top part of the rod and the link. In other words, the top part of the cylindrical rod pulls down the extensions to the side in a semicircular pattern via two consecutive cam mechanisms and a pedal lever, lifting the toilet seat by pulling down the extensions. The distance from the link to the hinges is proportional to the size of the folded portion of the cylindrical rod. The same effect is achieved, if the folded rod portion that acts as a cam is directly connected to the extensions instead of the link, and the cylindrical rod is straight and works as a follower between the lever and the extensions. In this case, the top part of the rod works as a follower and the cam works as a link creating one single cam mechanism. In other words the mechanism can use only one cam, one follower and no static ring. The snakelike shaped rod or the straight rod is pulled down at the bottom by a lever class 1 with an axis as fulcrum and an angle less than 180 degrees. This lever class 1 with an axis as a fulcrum transports the force from the front side of the toilet bowl to the distance perpendicularly below the link or cam that is attached to the extensions. This lever has a pedal 46 at the front where the force is applied, and the axis or pivot runs through the bottom side of the toilet bowl. When the force is applied to the pedal 46, the lever at the back pulls down the bottom part of the rod.

If the static ring and the folded rod are used or the straight rod is used, the same effect is achieved with the same lever. When the pedal is released, the toilet seat slowly comes down due to the gravity and the counterweight on the extensions.

The Improved Sanitary Toilet tank houses the toilet seat cover dispensers, as well as the actual flushing mechanism. Taken separately, the toilet seat cover dispensers are positioned on both sides at the base of the tank, while the flushing mechanism is housed within the remaining, open portion of the tank. The toilet seat cover dispensers are contained within integrated watertight compartments, easily accessed via hinged access panel located on the front or side of the compartment and inside of this compartment a removable horizontal dowel is mounted. This dowel is loaded with a roll of sanitary paper which serves as the actual toilet seat cover, with the ends of the paper fed through rollers and activated by way of a single spring effect foot pedal positioned at the base of the toilet bowl. The rollers have a gear built on the sides, and the gears are one direction spin gear.

The foot pedal acts as a lever class 1 similar to the pedal previously described in the toilet seat mechanism. The mechanism has a small structure to achieve the function. The small structure contains racks at front and is pulled by lever down, and pulled by springs up in opposite direction. This small structure is located below the tank, and is guided by holes at the bottom embedded at the back wall of the tank and in the interior corner of the paper dispenser compartment. The racks go directly in contact with the gears on the rollers. When the racks go up and down, they drive the gears to spin, thus spinning the rollers. The paper is pulled from the dowel by the rollers, driving the paper over the extensions, and out of the tank through a slotted opening which runs along the base of each compartment, thus feeding the paper onto the sides of the toilet seat, encompassing the surface of the seat completely.

In addition to the integrated seat cover dispenser, the Improved Sanitary Toilet tank houses the actual flushing mechanism. This mechanism includes the filler valve, filler float, overflow tube and flush valve. The improved flushing mechanism is composed of a lever class 1 with an extended axis as fulcrum to transport the lever from the front to the back of the tank at an angle less than 90 degrees, in other words, a regular flushing lever with an elongated pivot and two handles on both extremes going through the front and back walls of the tank. The front flushing valve is similar to most tanks. The back part lever or handle helps to flush the toilet. This back handle is connected to a pedal lever mechanism placed at the bottom of the toilet bowl. The connection between the flushing back handle and the lever at the bottom is done by a single connection rod. The bottom pedal lever is class 1 similar to the lever previously mentioned for the tank. This lever transports the force from the front side of the toilet bowl to the distance perpendicularly below the back handle of the tank. When the pedal is pressed, the lever pulls down the connection rod, pulling down the back handle, flushing the toilet seat without using the front handle.

The toilet seat and lid are manufactured of heavy-duty plastic, wood or similar materials and are produced in a variety of colors to correspond with existing bathroom decor. As with traditional toilet seats, the Improved Sanitary Toilet is connected to the existing toilet bowl by way of treaded plastic bolts or screws, which run through the rear of the unit. As mentioned the Improved Sanitary Toilet is operated by way of a foot pedal, connected to the underside of the seat and lid by way of elongated lever, which protrudes from the side of the seat and is positioned directly beside that which is utilized to operate the toilet flush valve. It is worth to mention that each pedal can be configured on each side of the toilet seat.

The Improved Sanitary Toilet is a practical product invention, which provides consumes a simple, yet clever means of flushing the toilet, as well as lifting and lowering the toilet seat. Featuring an integrated dispenser mechanism, which releases a sanitary toilet seat cover over the toilet seat, use of this product spares the user exposure to harmful germs and bacteria which lingering on the surface of the seat. As such, use of this product offers consumers an easy means of maintaining a healthy and fresh bathroom, while protecting themselves from exposure to harmful agents. Reasonably priced, the Improved Sanitary Toilet is well received by the general consumer populace.

Although this invention has been described with the specific embodiments, it is not intended to be limited thereto and various modifications which will become apparent to the person of ordinary skills in the art are intended to fall within the spirit and scope of the invention as described herein taken in conjunction with the accompanying drawings and the appended claims.

The invention claimed is:

1. A hands free toilet device, comprising:

a toilet having a back, a base and two sides; two paper dispensers; a first depressable foot pedal connecting to a first rod which first rod is connected to a lid of a toilet seat and a second depressable foot pedal connects to a second rod which rod connects to the toilet seat, wherein depression of a first depressable pedal lifts the first rod which lifts the lid of the toilet seat and wherein depression of the second depressable foot pedal lifts the second rod which second rod lifts the toilet seat, and wherein the lid of the toilet is attached to a tank or to the center portion of a pivot between toilet seat hinges and wherein the device further comprises two lever extensions at the back, one extension on each side of the toilet seat, and wherein each extension uses toilet seat hinges as fulcrum to lift the toilet seat, and wherein the extensions guide paper towards the toilet seat from the paper dispensers at both sides of the toilet at the base of the tank.

2. The hands free toilet device of claim 1 further comprising weights at the ends of the extensions wherein the weights at the ends of the extensions serve as counterweights for the toilet seat, and wherein the extensions hold a link for a cylindrical rod folded to work as a cam, and wherein this folded rod connects the extensions with a pedal at the bottom side of the toilet bowl, wherein a portion of the folded rod is displaced up and down through a static ring connected to the toilet bowl, and wherein the folded portion of the rod operates as a cam and produces a semicircular movement at a top of the rod, and wherein the top of the rod becomes a follower that pulls the extensions down to the side by a second cam mechanism between the top part of the rod and the link.

3. The hands free toilet device of claim 2 wherein the distance from the link to the hinges is proportional to the size of the folded portion of the cylindrical rod, wherein the rod portion acts as a cam directly connected to the extensions, and the cylindrical rod is straight and works as a follower between the lever and the extensions wherein the top part of the rod works as a follower and the cam works as a link creating one single cam mechanism.

4. The hands free toilet device of claim 1 having one extension, one cam, one follower and no static ring, and wherein a folded rod or the straight rod is pulled down at the bottom by a lever having an axis as fulcrum and an angle less than 180 degrees, and wherein the lever transports the force from the toilet bowl to perpendicularly below the link that is attached to the extensions, and wherein this lever has a pedal at the front of the toilet where force is applied, and the axis runs through the bottom side of the toilet bowl, and when force is applied to the pedal, the lever at the back pulls down the bottom part of the rod, and wherein when the pedal is released, the toilet seat slowly comes down due to the gravity and the counterweight on the extensions.

* * * * *